US005361420A

United States Patent [19]

Dobbs et al.

[11] Patent Number: 5,361,420

[45] Date of Patent: Nov. 8, 1994

[54] PROTECTIVE HEAD GEAR FOR WRESTLERS

[75] Inventors: Patrick E. Dobbs; Christopher A. Empero, both of Simi Valley, Calif.

[73] Assignee: C & P Products, Simi Valley, Calif.

[21] Appl. No.: 39,985

[22] Filed: Mar. 30, 1993

[51] Int. Cl.[5] ..... A42B 7/00

[52] U.S. Cl. ..... 2/425; 2/421; 2/423

[58] Field of Search ..... 2/171, 209.3, 209.5, 2/209.7, 410, 411, 412, 414, 421, 423, 425, DIG. 6; 24/306; 132/57.1, 58

[56] References Cited

U.S. PATENT DOCUMENTS

| | | | |
|---|---|---|---|
| 1,714,275 | 5/1929 | Mullins | 2/425 |
| 3,588,914 | 6/1971 | Ihnat | 2/421 |
| 3,594,815 | 7/1971 | Reese | 2/421 |
| 3,628,191 | 12/1971 | Douglas | 2/421 |
| 3,789,427 | 2/1974 | Aileo | 2/423 |
| 4,843,642 | 7/1989 | Brower | 2/423 |
| 4,862,563 | 9/1989 | Flynn | 24/306 |

OTHER PUBLICATIONS

"Big I Headgear" advertisement of Sep. 28, 1970.

*Primary Examiner*—Clifford D. Crowder
*Assistant Examiner*—Diana L. Biefeld
*Attorney, Agent, or Firm*—David O'Reilly

[57] ABSTRACT

A protective head gear for both male and female amateur wrestlers that is light in weight, easy to put on and take off, and provides excellent protection against ear damage during a match by providing resilient ring-shaped foam ear protectors. The head gear is formed of a nylon netting material and covers substantially the entire scalp. Pockets on either side have resilient oval ring-shaped foam pads that cover and protect the ears. A very secure chin strap is provided by a bifurcated strap having hook and loop material on either inside surface that mates with and pinches a double sided hook and loop strap between the bifurcated straps. Portions of the head gear covering the top of the head can be left open to provide further ventilation. An optional protective foam pad at the front of the head gear provides protection against head butts.

6 Claims, 1 Drawing Sheet

PROTECTIVE HEAD GEAR FOR WRESTLERS

FIELD OF THE INVENTION

This invention relates to protective athletic head gear and more particularly relates to protective head gear for amateur wrestlers.

BACKGROUND OF THE INVENTION

A common problem in the sport of amateur wrestling is damage to the ears often called "cauliflower ears". To prevent this problem a variety of protective head gear have been designed. This head gear is intended to protect the ears from damage during matches but still must allow the amateur wrestler to hear. The wearer must be able to hear instructions from the referee of the match but also should be able to hear coaching instructions to be effective during the match. Anything that impairs hearing can make it difficult to anticipate moves or wrestling tactics.

Presently protective hear gear is in the form of cups or plates fastened around the head with straps joining the cups that are secured by a chin strap. A protective wrestling helmet of this type is shown in U.S. Pat. No. 3,596,288 issued Aug. 3, 1971. The cups shown in this patent are triangular shaped ear guards made out of a rigid plastic material with a soft lining to prevent abrasion of the ears. This head gear while providing some protection is not entirely satisfactory because of the hard plastic covering and the difficulty in donning the head gear. The plastic cups only protect the area around the ear and can easily slip during head holds or other maneuvers.

Another similar head gear protective device has a four strap design for the triangular ear guards. This head gear is in the form of metal cups covered with a soft foam plastic. A problem with this head gear is that after a period of use the protective foam covering deteriorates and has split allowing the hard metal cup to contact the ear of the user.

This head gear also does not permit the user to have long hair. New hair dress rules for amateur wrestlers will only allow long hair if worn in a hair net where it is kept out of the way. Present protective head gear for wrestlers is inadequate to keep long hair out of the way and is particularly unsuitable for women wrestlers. Therefore amateur wrestlers have been using the hard cup protective gear with additional gear like swim caps or hair nets to keep long hair out of the way. However the head gear is uncomfortable when worn this way and doesn't stay on.

It is one object of the present invention to provide protective head gear for amateur wrestlers that provides excellent protection for a wrestlers ears.

Yet another object of the present invention is to provide protective head gear for amateur wrestlers that is light and durable.

Still another object of the present invention is to provide protective head gear for amateur wrestlers that is easy to put on and take off.

Still another object of the present invention is to provide protective head gear for amateur wrestlers that covers the entire skull allowing a wearer to completely cover hair and meet new hair dress rules.

Yet another object of the present invention is to provide protective head gear for amateur wrestlers that includes a protective foam pad to protect against head butts.

BRIEF DESCRIPTION OF THE INVENTION

The purpose of the present invention is to provide a new type of athletic head gear that will provide protection from "cauliflower ears" for amateur wrestlers, meet hair dress codes and be light and non-confining.

The head gear of the present invention is comprised of a porous cloth-like net material that fits around the entire scalp and is fastened under the chin with a double-sided safety strap. The head gear covers most of the head from the top of the forehead or frontal bone around the occipital area to the back or nape of the neck and has ear pieces that incorporate resilient ring-shaped foam ear protective coverings that protect the ears from damage. This ear covering also has a central hole to allow the wearer to be able to hear very well.

Since amateur wrestling can be a very rough sport with tactics including a variety of head holds it is imperative that the head gear maintain its position. The head gear of this invention straps safely and securely under the chin with a double sided strap and substantially covers the entire head to help prevent any slipping. Additionally the unique chin safety strap prevents the head gear from being dislodged. The chin strap is comprised of an elongate strap that extends from the temporal area of the head adjacent and below the ear to under the chin and has hook and loop (i.e. Velcro) material on both sides. This strap mates with a second strap extending from the temple area below the other ear under the chin that is bifurcated into two shorter straps. The inner surfaces of the bifurcated straps are also covered with a hook and loop material to mate with the matching hook and loop material on the single strap. This method of fastening the strap provides a double locking fastening method of hook and loop material commonly know by the trademark "Velcro" that is not easily separated.

An optional but preferred modification includes a resilient foam pad to provide protection against head butts. Head butts during a rough match frequently occur. These head butts can cause facial cuts particularly in the area of the forehead or frontal bone. To protect against this a resilient foam pad is sewn into a pocket along the anterior edge of the head gear.

In another optional embodiment portions of the scalp area of the head gear are left open to provide ventilation to the head because of the strenuous activity of amateur wrestling. The head gear still extends from the forehead around the occipital area to the nape of the neck with various triangular portions on either side on the top and sides of the head being open for ventilation.

The present invention provides the function of a full hair net wrestling head gear while providing better protection for damage to the ears. The new head gear is much lighter in weight, flexible and enables the wrestler to hear much better because there are less obstruction to the ear. The safety strap enable the wrestlers to wrestle hard and not worry about his head gear becoming undone. Once adjusted the head gear stays in place. There are no sharp edges or hard surfaces which the present style head gear has that can be uncomfortable to wear for the wrestler.

The above and other features of this invention will be fully understood from the following detailed description and the accompanying drawings, in which:

DETAILED DESCRIPTION OF THE INVENTION

The proposed protective head gear of the present invention covers substantially the entire head from the frontal bone at the top of the forehead, around the occipital area and down below the back of the head to the nape of the neck. The head gear is comprised of a woven net fabric material generally indicated at 10 forming a scalp portion 12 extending from an anterior section 14 covering a portion at the top of the forehead to a posterior portion 16 extending around the back of the head to the nape of the neck. The material is preferably a strong nylon netting material including a synthetic material such as Lycra. Thus head gear 10 is preferably constructed of this net-like woven material to provide good ventilation to the head. Amateur wrestling is strenuous exercise and participants can perspire heavily. Such material allows ample ventilation of the head as well as around the ears, that is not available with present protective head gear for wrestlers.

Figure 2:
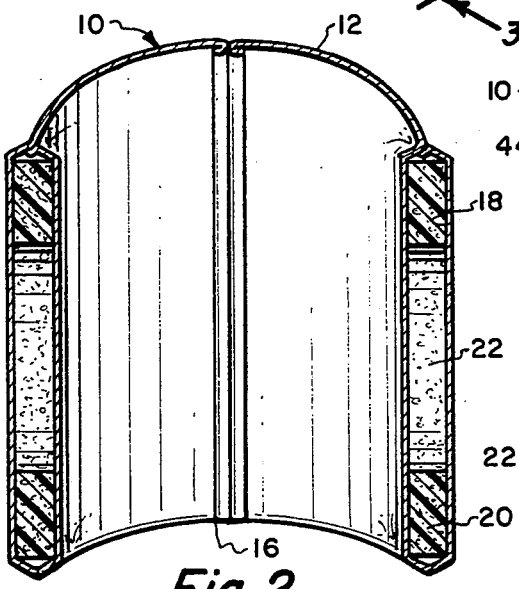
FIG. 2 is a sectional view taken at 2—2 of FIG. 1.

As shown in FIG. 2, pockets 18 are formed on either side of the head gear 10 for enclosing resilient ring-shaped foam ear protectors 20 having center holes 22. Preferably the ear protectors 20 are in a somewhat oval shape with a large opening 22 to allow the wearer to hear efficiently. Hearing is important to hear the instructions of a referee as well as instructions from coaches.

The protective ear pieces are constructed of a resilient foam. The foam is made by pouring a liquid foam into a mold which is rounded or chamfered on one side. Preferably the protective resilient oval shaped foam ear pieces are about six inches long by five inches wide with a center hole that measures approximately three inches by two and three eighths inches. The netting fabric for the skull cap is made of a material that is about two thirds nylon and one third a synthetic. The seams are kept to a minimum and double stitched to make them durable. The resilient foam protective ear piece is approximately one half to five eighths inches thick.

An advantage of the head gear 10 is that it completely covers the scalp allowing excess hair to be tucked underneath the posterior portion 16 permitting wrestlers, particularly female participants, to meet hair dress codes. The netting material from which the head gear 12 is constructed is sufficiently flexible to stretch and allow some extra room to accommodate long hair.

Another unique feature of the protective head gear is the safety chin strap 25 that securely holds the skull cap 10 on the wrestlers head. It is imperative that the cap not slip or come loose during matches. For this reason the chin strap for securing a head gear 10 on the wearers head is comprised of a pair of straps 26 and 28. Chin strap 25 is provided with hook and loop material known by the trademark "Velcro" on either side. Strap 28 is bifurcated at 32 to provide a pair of shorter straps 34 and 36. These straps also include hook (i.e. Velcro) material 38 on opposite inside surfaces. Strap 26 has loop material on both sides.

This unique chin strap allows the head gear to be quickly and easily as well as securely fastened on the head. The wearer can easily slip the cap 10 around the head and quickly fasten the straps 26 and 28 by mating loop material 30 on either side of strap 26 with hook material 38 on straps 34 and 36 pinching strap 26 between them. This provides a secure fastening device which will not easily come apart. Increased tension on chin strap 25 will tend to force them together holding more securely rather than pull them apart. This strap arrangement avoids buckles, belts and other hard fastening devices that can injure a wrestling participant. It also allows the head gear 10 to be easily put on or removed with the fastening taking only a few seconds.

Figure 4:
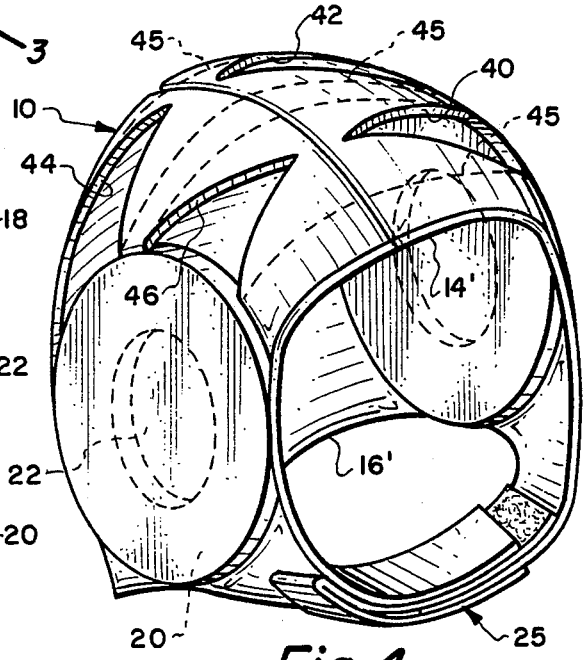
FIG. 4 is an isometric view of an optional embodiment of the wrestlers protective head gear according to the invention.
Figure 3:
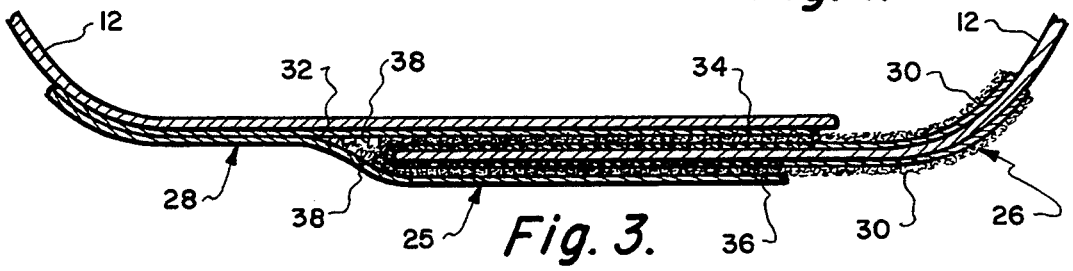
FIG. 3 is a sectional view of the unique chin strap taken at 3—3 of FIG. 1.

In the optional embodiment shown in FIG. 4 the cap 10 is constructed substantially as before having an anterior portion 14' extending over a portion of the frontal bone or forehead and a posterior portion 16' extending around to the back or nape of the neck. Again it provides substantially complete coverage of the scalp allowing long hair to be tucked beneath the posterior portion 16'. The resilient foam ear protective padding and coverings 20 are included in side pockets as before. However with this particular head gear triangular sections 40, 42, 44 and 46 are removed in the top to provide additional ventilation to the head area and make the cap seem less confining to the wearer.

As an alternative the additional ventilation could be provided by three panels in the front, middle and rear with spaces between them. This provides open rectangular areas 45 indicated by the phantom lines. For example triangular openings 40, 42, 44 and 46 would then become two rectangular openings 45. The cap constructed as illustrated in FIG. 4 still provides the unique, efficient protection for the ears while allowing the wearer to hear but also is securely fastened and difficult to dislodge. It can be quickly removed and put back on in seconds.

Figure 1:
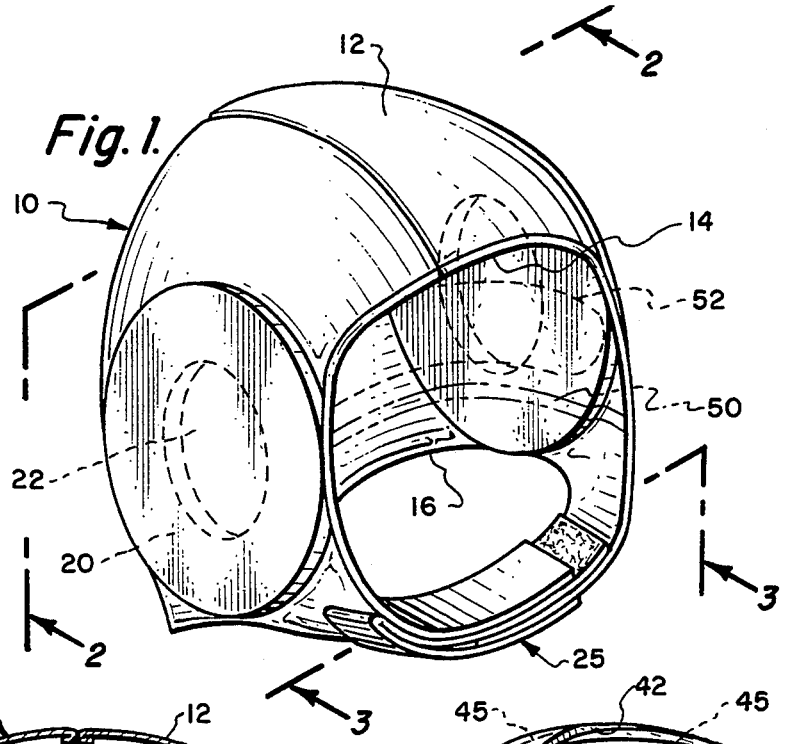
FIG. 1 is a perspective view of a wrestlers protective head gear constructed according to the invention.

An additional protective feature of head gear 10 is to provide a butt pad in the anterior portion 14 to protect against head butts. This is provided by an additional pocket 50 shown in phantom in FIG. 1. This pocket 50 extends down over most of forehead to provide protection against head butts. Resilient foam pad 52 about three to four inches long and one and a half to two inches long and one half to five eighths inches thick will protect against head butts. Resilient foam pad 52 will blunt the force of a head butt, sometimes intentionally inflicted by an opponent, and will prevent cuts that could cause an unfortunate, as well as, unfair disqualification. No protective head gear presently available provides such protection.

This invention is not to be limited by the embodiment shown in the drawings and described in the description which is given by way of example and not of limitation, but only in accordance with the scope of the appended claims.

What is claimed is:

1. Protective headgear for use in the sport of wrestling comprising; a stretchable netting material forming a head covering from the frontal bone to the nape of the neck and covering the ears; a pair of packets formed in the portion of said stretchable netting material covering the ears; resilient foam ring-shaped means secured in said pair of packets; a pair of straps on a front lower portion of said head covering for securing said head cover under the chin; said pair of straps including fastening means for fastening the straps beneath the chin; said fastening means comprising a bifurcated end on one strap forming a pair of fasteners; said bifurcated end receiving and securely clamping the end of the other second strap; said bifurcated ends on said first strap and the end of the second strap having mutually mating fasteners; whereby said bifurcated strap securely clamps the second strap when lateral forces are applied substantially preventing them from coming apart.

2. The headgear according the claim 1 wherein said pair of straps comprises a first strap extending downward from a temporal area of said head covering; said first strap having hook and loop material on the interior surface of each side of said bifurcated end; a second strap extending downward from the other temporal area of said head covering; said second strap having hook and loop material on both sides; said hook and loop material on said bifurcated end mating with the hook and loop material on the second strap to securely clamp said second strap therebetween.

3. The headgear according to claim 2 including resilient protective means along an upper frontal portion of said head covering; said resilient protective means constructed and arranged to protect the head against head butts during a wrestling match.

4. The headgear according to claim 3 in which said upper frontal resilient protective means comprises a frontal pocket formed in said stretchable netting material at an anterior frontal portion; and a resilient foam pad secured in said frontal pocket.

5. The headgear according to claim 1 including resilient protective means along an upper frontal portion of said head covering; said resilient protective means constructed and arranged to protect the head against head butts during a wrestling match.

6. The headgear according to claim 5 in which said upper frontal resilient protective means comprises a frontal pocket formed in said stretchable netting material at an anterior frontal portion; and a resilient foam pad secured in said frontal pocket.

* * * * *